US011629033B2

(12) United States Patent
Jin et al.

(10) Patent No.: US 11,629,033 B2
(45) Date of Patent: Apr. 18, 2023

(54) INTEGRAL LIFTING SYSTEM AND LIFTING METHOD FOR ASSEMBLED MEMBERS

(71) Applicant: Southeast University, Jiangsu (CN)

(72) Inventors: Hui Jin, Jiangsu (CN); Haihan Jiao, Jiangsu (CN); Zhaozhong Li, Jiangsu (CN); Guansi Liu, Jiangsu (CN); Libin Wang, Jiangsu (CN)

(73) Assignee: Southeast University, Jiangsu (CN)

( * ) Notice: Subject to any disclaimer, the term of this patent is extended or adjusted under 35 U.S.C. 154(b) by 46 days.

(21) Appl. No.: 17/352,380

(22) Filed: Jun. 21, 2021

(65) Prior Publication Data

US 2022/0227609 A1 Jul. 21, 2022

(30) Foreign Application Priority Data

Jan. 20, 2021 (CN) ..... 202110076409.1

(51) Int. Cl.
*B66C 23/26* (2006.01)
*B66C 23/80* (2006.01)

(52) U.S. Cl.
CPC ..... *B66C 23/26* (2013.01); *B66C 23/80* (2013.01)

(58) Field of Classification Search
CPC ..... B66C 23/20; B66C 23/208; B66C 23/26; B66C 23/28; B66C 11/14; B66C 6/00; B66C 19/00; B66C 19/02
See application file for complete search history.

(56) References Cited

U.S. PATENT DOCUMENTS 3,302,801 A * 2/1967 Poroli ..... B66C 19/02 212/176
4,381,839 A * 5/1983 Engler ..... B66C 19/02 238/21
2018/0086611 A1* 3/2018 Helmens ..... B66C 19/02
2018/0283279 A1* 10/2018 Hatcher, Jr. ..... B66C 19/02
2022/0097805 A1* 3/2022 Maher ..... B66C 19/02

FOREIGN PATENT DOCUMENTS

CN 113135502 A * 7/2021 ..... B66C 19/00
FR 2369991 A * 7/1978 ..... B66C 19/02

* cited by examiner

*Primary Examiner* — Sang K Kim
*Assistant Examiner* — Nathaniel L Adams
(74) *Attorney, Agent, or Firm* — JCIP Global Inc.

(57) ABSTRACT

Disclosed are an integral lifting system and lifting method for assembled members. The integral lifting system includes fixing mechanisms and more than four vertical stand columns. The four vertical stand columns are located at four corners of a building, the building is located in a region encircled by the vertical stand columns, a transverse rail beam is disposed between every two vertical stand columns, one end of the transverse rail beam is mounted at the top of one vertical stand column, and the other end is mounted on the top of the other stand column. The transverse rail beam is provided with an operation trolley, a jib crane is disposed on an upper surface of the operation trolley, and a lifting mechanical arm is disposed on an outer side surface of the operation trolley. A hydraulic jacking mechanism is disposed at the bottoms of the vertical stand columns.

8 Claims, 9 Drawing Sheets

INTEGRAL LIFTING SYSTEM AND LIFTING METHOD FOR ASSEMBLED MEMBERS

CROSS-REFERENCE TO RELATED APPLICATION

This application claims the priority benefit of China application serial no. 202110076409.1, filed on Jan. 20, 2021. The entirety of the above-mentioned patent application is hereby incorporated by reference herein and made a part of this specification.

BACKGROUND

Technical Field

The present invention relates to the field of lifting of assembled members in civil engineering, and particularly relates to an integral lifting system and lifting method for assembled members.

Description of Related Art

An assembled structure is a form of structure produced and manufactured in a factory in a prefabricated manner and transported to a site for assembly. Compared with a traditional cast-in-place structure, the assembled structure has the advantages of high production and installation speed, high building quality, green and environment-friendly effects of operation environments, low construction process cost and the like, and is thus widely used in China in recent years.

Compared with a cast-in-place structure, the assembled structure has the advantages that prefabricated members of the assembled structures have heavy mass and big volumes, the required quantity is great, and additionally, the requirements on lifting precision and stability in the lifting process are high, so that great-tonnage and high-performance hoisting equipment is needed. At present, common hoisting equipment in China is mainly a tower crane and a self-propelled crane. The tower crane can be mounted at a side surface of a building or in an elevator pipeline inside the building, and can realize high-altitude operation. However, the existing tower crane in China has limited tonnage, group tower operation is generally needed in a construction site, and a higher requirement is provided for construction management. The self-propelled crane is more convenient and flexible in construction, but has the limited lifting height, and is often matched with a tower crane for use. The two traditional lifting modes are not optimal lifting solutions for the assembled member, and there is an urgent need for large-scale lifting equipment for assembled members with the advantages of great lifting tonnage, lifting stability, high installation precision and capability of being reliably connected with a building body in a construction site.

SUMMARY

Invention objectives: to realize fast and stable lifting of big-volume great-tonnage assembled members, to require the whole lifting system to realize installation convenience and a reliable connection mode with a building body at the same time, and to achieve a high safety coefficient. Therefore, an integral lifting system and lifting method for assembled members are provided, and are used to complete a lifting process of the assembled members.

Technical solution: in order to achieve the above objectives, the present invention adopts the following technical solution. An integral lifting system for assembled members includes fixing mechanisms and more than four vertical stand columns. The four vertical stand columns are located at four corners of a building, the building is located in a region encircled by the vertical stand columns, a transverse rail beam is disposed between every two vertical stand columns, one end of the transverse rail beam is mounted at a top portion of one vertical stand column, and the other end of the transverse rail beam is mounted on a top portion of the other stand column. The transverse rail beam is provided with an operation trolley, a jib crane is disposed on an upper surface of the operation trolley, and lifting mechanical arms are disposed on an outer side surface of the operation trolley. A hydraulic jacking mechanism is disposed at bottom portions of the vertical stand columns.

Each of the vertical stand columns includes more than two vertically disposed first cuboid frameworks, each of the first cuboid frameworks is formed by welding first vertical square steel pipes and first horizontal square steel pipes, and connecting sheets are respectively disposed on two side surfaces of the vertical square steel pipes at one side of the first cuboid frameworks near a facade of the building. The connecting sheets are configured to be vertically and slidingly connected with the fixing mechanisms. First connecting lugs are disposed on the horizontal square steel pipes at upper and lower ends of each of the first cuboid frameworks, and the vertically adjacent two first cuboid frameworks are fixedly connected through the first connecting lugs.

The transverse rail beam includes operation rails and more than two transversely disposed second cuboid frameworks, each of the second cuboid frameworks is formed by welding second vertical square steel pipes and second horizontal square steel pipes, second connecting lugs are disposed on the second vertical square steel pipes at the left and right ends of each of the second cuboid frameworks, and the left and right adjacent two second cuboid frameworks are fixedly connected through the second connecting lugs. The operation rails are mounted on an upper surface of the second cuboid frameworks, and the operation rails are two parallel I-shaped rails.

The hydraulic jacking mechanism includes a fixing platform, steel anchor bolts, hydraulic oil cylinders, a jacking platform, a clamper, rotating gears and two lifting frames. The steel anchor bolts are fixed to a lower surface of the fixing platform, the hydraulic oil cylinders are fixedly mounted on an upper surface of the fixing platform, pistons of the hydraulic oil cylinders are fixedly mounted on an lower surface of the jacking platform, the clamper and the lifting frames are all fixedly mounted on the upper surface of the jacking platform, the clamper is positioned between the lifting frames, vertical wave-shaped grooves are formed in the lifting frames, the rotating gears are mounted on the jacking platform through a first rotating shaft, and the wave-shaped grooves are meshed and connected with the rotating gears.

Each of the fixing mechanisms includes steel grooves matched with the connecting sheets, support sheets, pin shafts, springs and a fixing plate. The steel grooves are welded onto the fixing plate, the fixing plate is fixed to a prefabricated member of the building through screw bolts, a forming direction of the steel grooves is identical to a sliding direction of the connecting sheets, and each of the support sheets is mounted on the top of the corresponding steel groove through the pin shafts, thereby realizing the rotation of the support sheets around the top portions of the steel grooves through the pin shaft. One end of each of the springs is fixed onto the fixing plate, and the other end each of the springs is fixed to a lower surface of the corresponding support sheet.

The operation trolley includes two first rear wheels, two first front wheels, second rotating shafts, fixing buckles, a trolley body, a conveying belt, third rotating shafts and rotating wheels. The vehicle body includes a trolley top plate and two trolley side plates. The two trolley side plates are respectively mounted at two sides of a lower surface of the trolley top plate. The second rotating shaft respectively penetrates through a center of each of the first rear wheels and a center of each of the first front wheels. Each of the second rotating shafts is a driving device, and is able to drive the corresponding first rear wheel or first front wheel to enable the trolley to move on the transverse rail beams. The fixing buckles are connected to two sides of the second rotating shafts. The upper ends of the fixing buckles are fixed to the lower surface of the trolley top plate. The first rear wheels and the first front wheels are in transmission connection through the conveying belt. One end of each of the third rotating shafts is disposed on the trolley side plate, the other end of each of the third rotating shafts is connected with the rotating wheels, the number of the rotating wheels is four, the two of the rotating wheels are located below the first front wheels, and the other two rotating wheels are located below the first rear wheels. The first rear wheels and the first front wheels are located at upper surfaces of the operation rails, and the rotating wheels are located in rail grooves at outer sides of middle portions of the operation rails.

The jib crane includes a rotary platform, third connecting lugs, a rotary shaft, a jib boom, a pole derrick, a steering rod, a first windlass, a second windlass and a first lifting hook. The rotary platform is mounted on an upper surface of the operation trolley, the third connecting lugs are disposed on the rotary platform, and the jib boom is rotationally connected with the third connecting lugs through the rotary shaft, so that the jib boom rotates in a vertical plane. The pole derrick and the first windlass are fixedly mounted on the rotary platform, the steering rod is disposed on a top portion of the pole derrick, and steel wire ropes fixed to an end portion of the jib boom bypass the steering rod at the top portion of the pole derrick to be wound on the first windlass and are configured to drag the jib boom to move. The second windlass is disposed at a bottom portion of the jib boom. The first lifting hook is disposed at the end portion of the jib boom, and steel wire ropes fixed to an end portion of the first lifting hook pass through the jib boom to be wound on the second windlass.

Each of the lifting mechanical arms includes horizontal I-shaped steel, vertical I-shaped steel, an L-shaped support frame, annular clamp buckles, a third windlass, first binding rings, second binding rings, a second lifting hook and a third lifting hook. The vertical I-shaped steel is fixedly mounted on the outer side surface of the operation trolley, and a lower surface of one end of the horizontal I-shaped steel near the operation trolley is fixedly connected to an outer side surface of the operation trolley through the L-shaped support frame. An included angle between the vertical I-shaped steel and the horizontal I-shaped steel is 90°. The first binding rings are disposed on the vertical I-shaped steel, the second binding rings are disposed above an outer end surface and a middle portion of the horizontal I-shaped steel, one end of each steel wire rope is connected with the corresponding first binding ring, and the other end of each steel wire rope is connected with the corresponding second binding ring. The annular clamp buckles are disposed below the outer end surface and the middle portion of the horizontal I-shaped steel to be used as fixed lifting points, and the steel wire ropes fixed to an end portion of the second lifting hook and an end portion of the third lifting hook respectively pass through the fixed lifting points to be wound on the third windlass.

Preferably, the integral lifting system for assembled members further includes lifting tools. Each of the lifting tools includes two transverse lifting beams, four L-shaped clampers and a lifting disc. Each of the transverse lifting beams includes hollow first square-shaped steel and second square-shaped steel, the second square-shaped steel is disposed in the first square-shaped steel, the second square-shaped steel is slidingly connected with the first square-shaped steel, the upper ends of the L-shaped clampers are fixedly connected with the second square-shaped steel, and clamping openings of the two L-shaped clampers on the same transverse lifting beam are disposed oppositely. Two first lifting rings are disposed on each of the first square-shaped steel, the lifting disc and the first lifting rings are connected through steel wire ropes, and a second lifting ring is disposed on the lifting disc. The second lifting ring is configured to hang the first lifting hook and/or the second lifting hook and/or the third lifting hook.

Preferably, each of the lifting frames is of a rectangular structure formed by welding vertical lifting steel pipes and horizontal fixed steel pipes.

Preferably, third inclined struts are welded in a framework plane of the rectangular structure of each of the lifting frames.

Preferably, fixing sheets are configured for reinforced connection in connecting positions of the hydraulic oil cylinders and the fixing platform.

Preferably, a first inclined strut is welded in a framework plane of each of four side surfaces of the first cuboid frameworks.

Preferably, a second inclined strut is welded in a framework plane of each of four side surfaces of the second cuboid frameworks.

Preferably, the number of the vertical stand columns is at least four.

Another technical objective of the present invention is to provide an integral lifting method for assembled members, realized based on the above integral lifting system for assembled members, and the method includes the following steps.

Step 1: after building integral positioning and stringing and completion of underground work construction, determining arrangement positions and a quantity of the vertical stand columns according to a scale of the building and a weight of prefabricated assembled members, fixing the hydraulic jacking mechanism in a corresponding position in advance, ensuring firmness and reliability of the steel anchor bolts, and inspecting performance of the hydraulic oil cylinders and the matched pistons.

Step 2: firstly fixing a first section of the first cuboid framework of the vertical stand column onto the jacking platform of the hydraulic jacking mechanism, and performing tight clamping by the clamper; then, taking the hydraulic jacking mechanism as a base to connect the vertical stand column with the transverse rail beams through the first connecting lugs, the second connecting lugs and the screw bolts, and mounting the operation trolley and lifting machinery on the transverse rail beams, wherein the lifting machinery includes the jib crane and the lifting mechanical arms; and then, debugging the lifting machinery to ensure normal operation in use.

Step 3: enabling the hydraulic oil cylinders and the matched pistons of the hydraulic lifting mechanism to start to operate, jacking the whole lifting system until the connecting sheets of the first section of the first cuboid framework pass through first steel grooves of the fixing mechanism and get supported by the support sheets horizontally disposed on upper sides of the first steel grooves so as to complete fixation between the lifting system and a building body, then completing a jacking process, and resetting the hydraulic oil cylinders and the matched pistons.

Step 4: completing lifting and assembly of all assembled members of a first storey of the building corresponding to the first section of the first cuboid framework of the building through mutual cooperation of the operation trolley, the jib crane and the lifting mechanical arms, wherein during the lifting of the assembled members, the following two modes are adopted according to volumes of the assembled members.

For small-size assembled members, a single-point lifting mode is adopted, and the assembled members are able to be lifted to a specified height only by using the jib crane cooperating with a lifting disc.

For big-size assembled members, a four-point lifting mode is adopted, the lifting mechanical arms are used, and cooperates with a lifting tool in a specific structure form to lift the assembled members to a specified height; in this process, the first lifting hook of the jib crane only cooperates with the second lifting hook and/or the third lifting hook; after the assembled members reach a specified height, the lifting mechanical arms stop operation, the jib crane further ascends, first lifting rings on transverse lifting beams are disengaged from the second lifting hooks and/or third lifting hooks of the lifting mechanical arms, and the assembled members are conveyed by the jib crane to a specified position for installation until the assembly of all assembled member of a current storey of the building is completed.

The lifting tool includes the transverse lifting beams, L-shaped clampers, the lifting disc and steel wire ropes; the first lifting rings on the transverse lifting beams are connected with the second lifting hooks and/or third lifting hooks of the lifting mechanical arms, and then, a second lifting ring on the lifting disc is connected with the first lifting hook of the jib crane;

Step 5: upwards jacking the lifting system for a standard section by using the hydraulic jacking mechanism until the first section of the first cuboid framework passes through second steel grooves of the fixing mechanism and gets supported by support sheets horizontally disposed on upper sides of the second steel grooves, and resetting the hydraulic oil cylinders and the matched pistons; and then, putting a new section of the first cuboid framework at a bottom portion of the lifting system, and completing fixation of the two sections of the first cuboid frameworks with the first connecting lugs and the screw bolts; and repeating steps 3 to 5 until the installation of the assembled members of each storey of the whole building is completed.

Compared with the prior art, the present invention has the following beneficial effects that compared with the prior art, the integral lifting system of the present invention is convenient and fast in installation, and occupies a small area of a construction site. The integral lifting system after installation is in a cage shape completely warping the building, reliable connecting devices are disposed between the integral lifting system and the building, the whole structure has a high safety coefficient. Through the cooperative use of the operation trolley, the jib crane, the lifting mechanical arms and the lifting tools, the stable lifting of great-tonnage heavy-weight assembled members can be realized, the lifting requirements of members in various sizes and specifications can be met, and the lifting requirements of members in different positions of the construction site can also be met.

DESCRIPTION OF THE EMBODIMENTS

Figure 1:
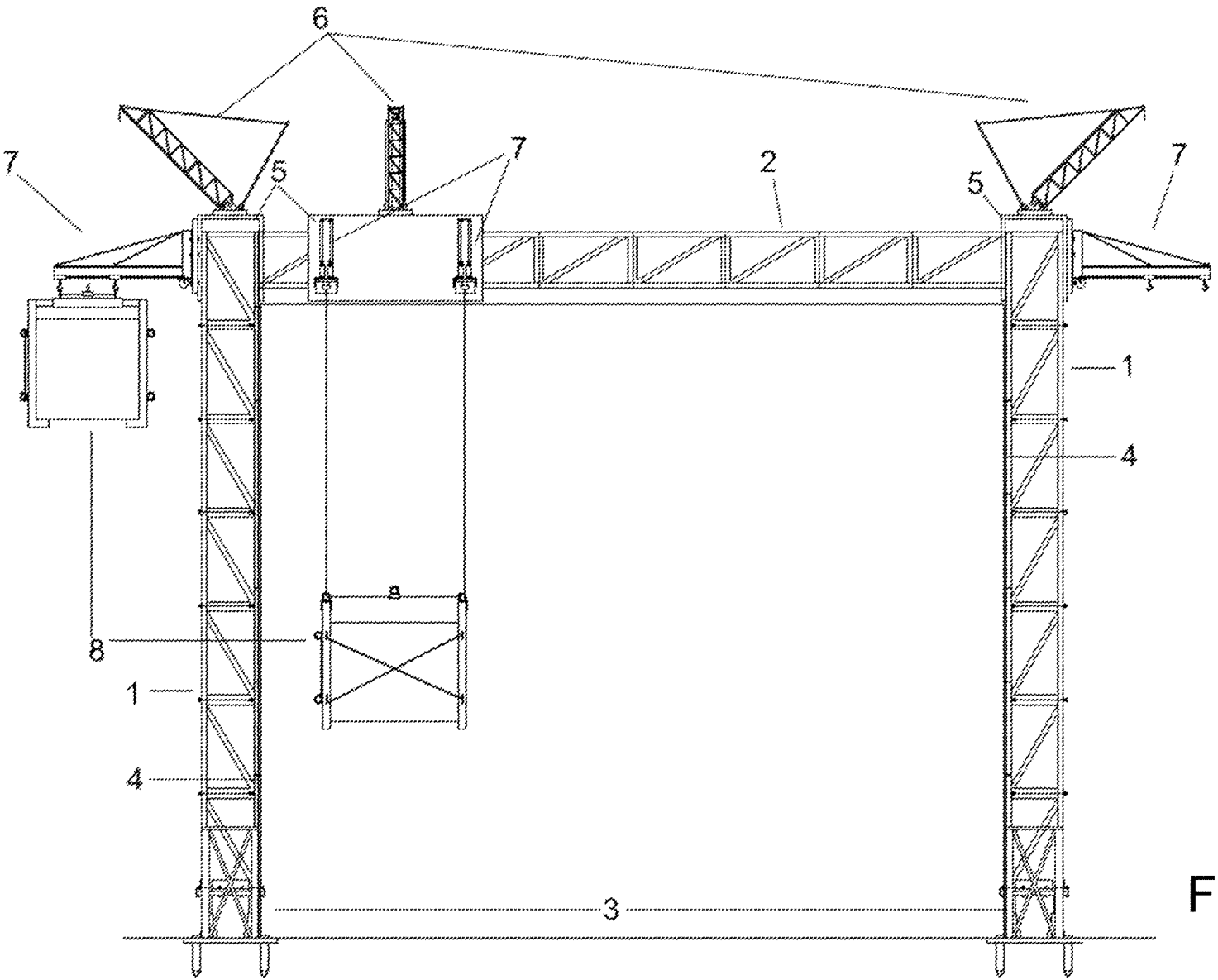
FIG. 1 is a front view of an integral structure of an integral lifting system for assembled members of the present invention.
Figure 2:
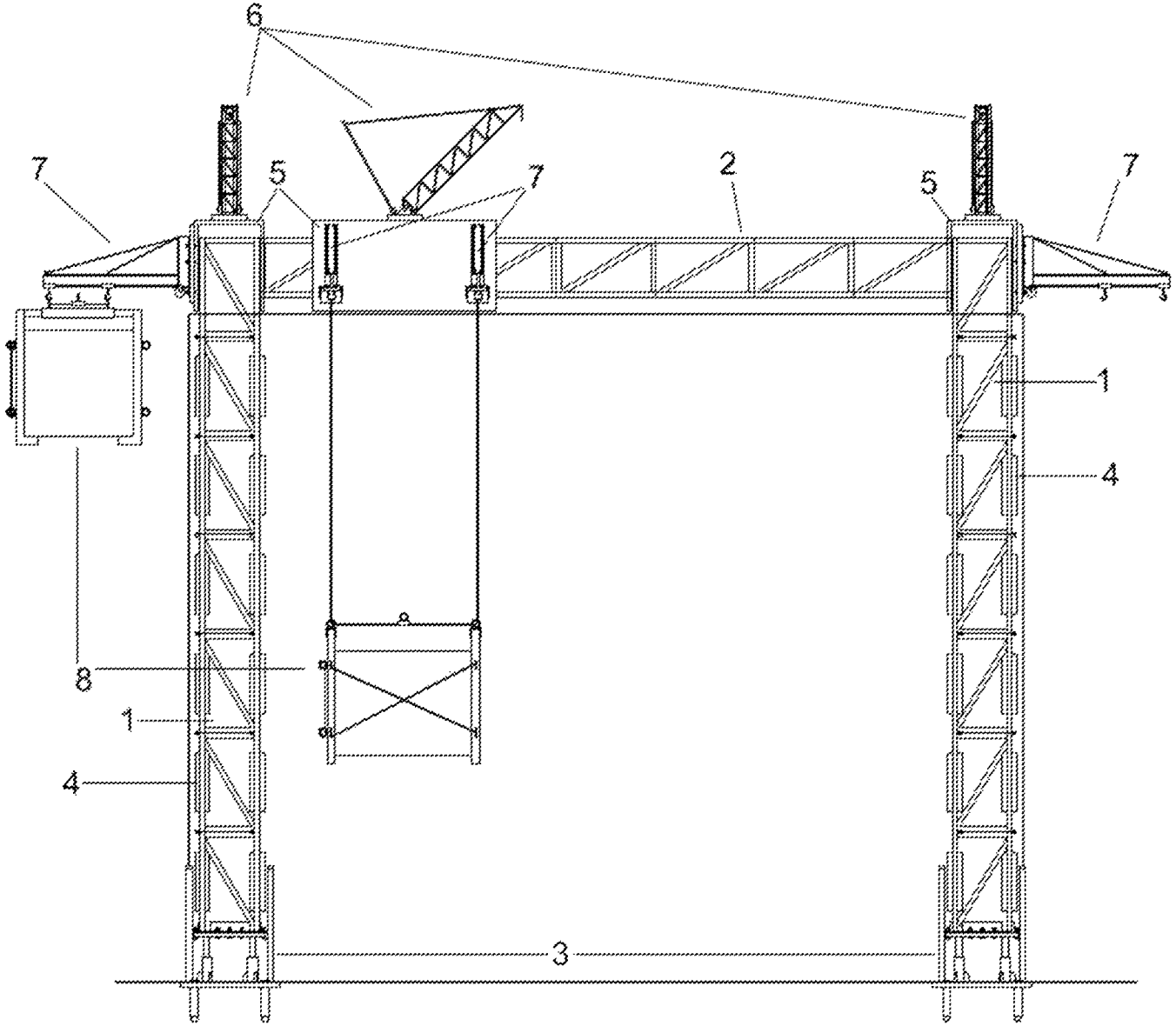
FIG. 2 is a side view of the integral structure of an integral lifting system for assembled members of the present invention.
Figure 3:
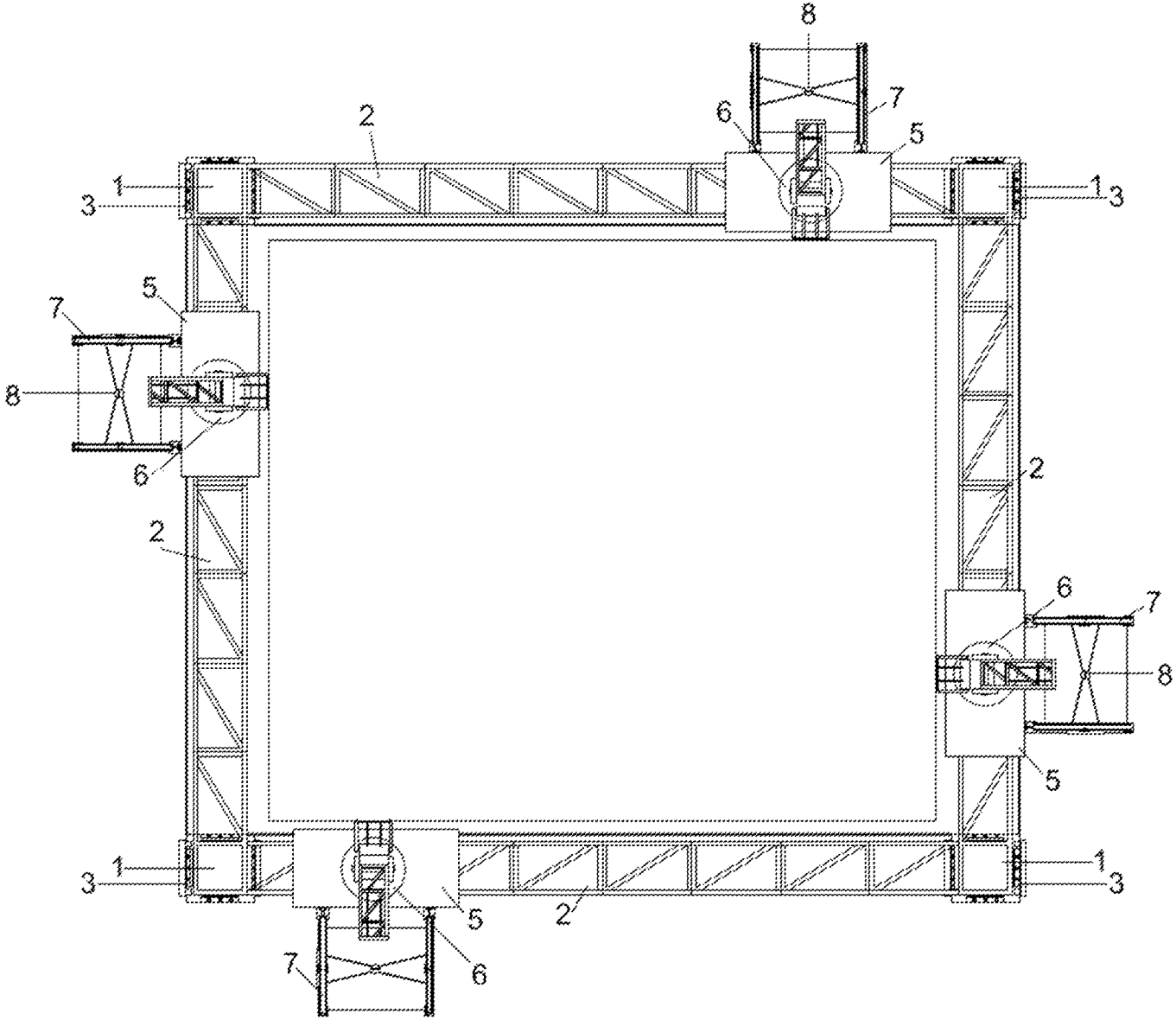
FIG. 3 is a top view of the integral structure of an integral lifting system for assembled members of the present invention.

The present invention will be further illustrated with reference to the drawings and specific embodiments, it should be understood that these examples are only used for illustrating the present invention and are not intended to limit the scope of the present invention, and modifications of various equivalent forms of the present invention made by those skilled in the art upon reading the present invention all fall within the scope of the appended claims.

An integral lifting system for assembled members, as shown in FIG. 1 to FIG. 11, includes fixing mechanisms and more than four vertical stand columns 1. The four vertical stand columns 1 are distributed in a rectangular shape, a building is located in a region encircled by the vertical stand columns 1, a transverse rail beam 2 is disposed between every two vertical stand columns 1, one end of the transverse rail beam 2 is mounted at the top portion of one vertical stand column 1, and the other end of the transverse rail beam 2 is mounted on the top portion of the other vertical stand column 1. The vertical stand columns 1 and the transverse rail beams 2 jointly form an integral framework of the lifting system, and the integral framework is fixedly connected with a facade of the building by the fixing mechanisms 4.

The transverse rail beam 2 is provided with an operating trolley 5, a jib crane 6 is disposed on an upper surface of the operating trolley 5, and lifting mechanical arms 7 are disposed on an outer side surface of the operating trolley 5, and are configured to meet the lifting requirements of different positions. Lifting tools can ensure the stability of the members in the lifting process. The operation trolley 5 drives the jib crane 6 and the lifting mechanical arms 7 to do reciprocating movement on the transverse rail beams 2, and cooperates with the lifting tools 8 to be used to complete the lifting process. A hydraulic jacking mechanism 3 is disposed at the bottoms of the vertical stand columns 1, and the hydraulic jacking mechanism 3 is configured to jack the structure.

As shown in FIG. 1 to FIG. 4, each of the vertical stand columns 1 includes more than two vertically disposed first cuboid frameworks 101, each of the first cuboid frameworks 101 is formed by welding first vertical square steel pipes 102 and first horizontal square steel pipes 103, a first inclined strut 104 is welded in a framework plane of each of four side surfaces of the first cuboid frameworks for reinforcement, the vertical stand columns 1 are disposed on the periphery of the building, and an arrangement space of the vertical stand columns should be comprehensively considered according to the scale of the building and the quality of lifted members, and the transverse rail beams 2 at the top are enabled not to generate instability overturning in the lifting process. Connecting sheets 105 are respectively disposed on two side surfaces of the first vertical square steel pipes 102 at one side of the first cuboid frameworks 101 near the facade of the building. The connecting sheets 105 are made of high-performance steel plates and are configured to be vertically and slidingly connected with the fixing mechanisms 4 so as to ensure the stability of the vertical stand columns 1. In order to ensure the accuracy and convenience of connection of the vertical stand columns 1 and the fixing mechanisms 4, a length of each section of the vertical stand columns 1 should be coordinate with a height of a standard storey of the building. First connecting lugs 106 are disposed on the horizontal square steel pipes 103 at upper and lower ends of each of the first cuboid frameworks 101, and the first connecting lugs 106 of the vertically adjacent two first cuboid frameworks 101 are fixedly connected through screw bolts 10.

Figure 5:
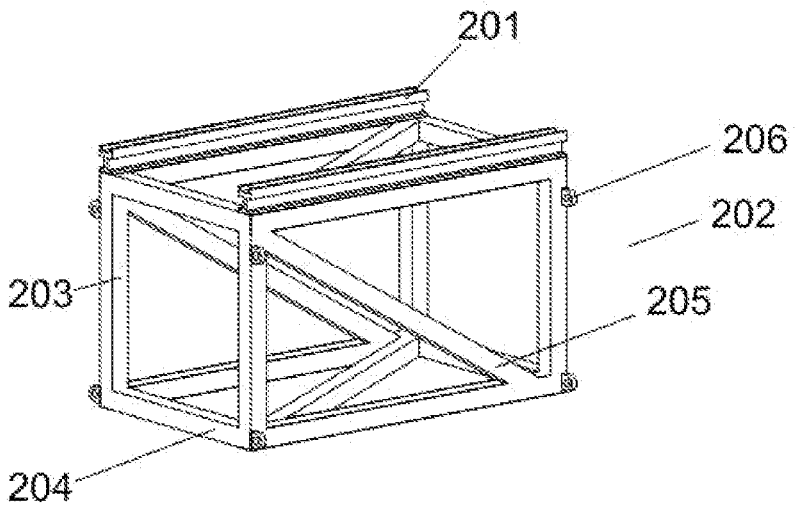
FIG. 5 is a schematic diagram of transverse rail beams of the integral lifting system for assembled members of the present invention.

As shown in FIG. 5, the transverse rail beam 2 is configured to connect and fix the top ends of the two vertical stand columns 1 to form an integral lifting system framework. A body structure of the transverse rail beam 2 is similar to the structure of the vertical stand column 1. The transverse rail beam 2 includes operation rails 201 and more than two transversely disposed second cuboid frameworks 202, each of the second cuboid frameworks 202 is formed by welding second vertical square steel pipes 203 and second horizontal square steel pipes 204, second connecting lugs 206 are disposed on the second vertical square steel pipes 203 at the left and right ends of each of the second cuboid frameworks 202, and the left and right adjacent two second cuboid frameworks 202 are fixedly connected through the second connecting lugs 206. A second inclined strut 205 is welded in a framework plane of each of four side surfaces of the second cuboid frameworks 202. For convenient operation of the operation trolley 5 on the transverse rail beams 2, two parallel operation rails 201 made of I-shaped steel are fixed to the top portion of the transverse rail beams 2 in a length direction.

Figure 7:
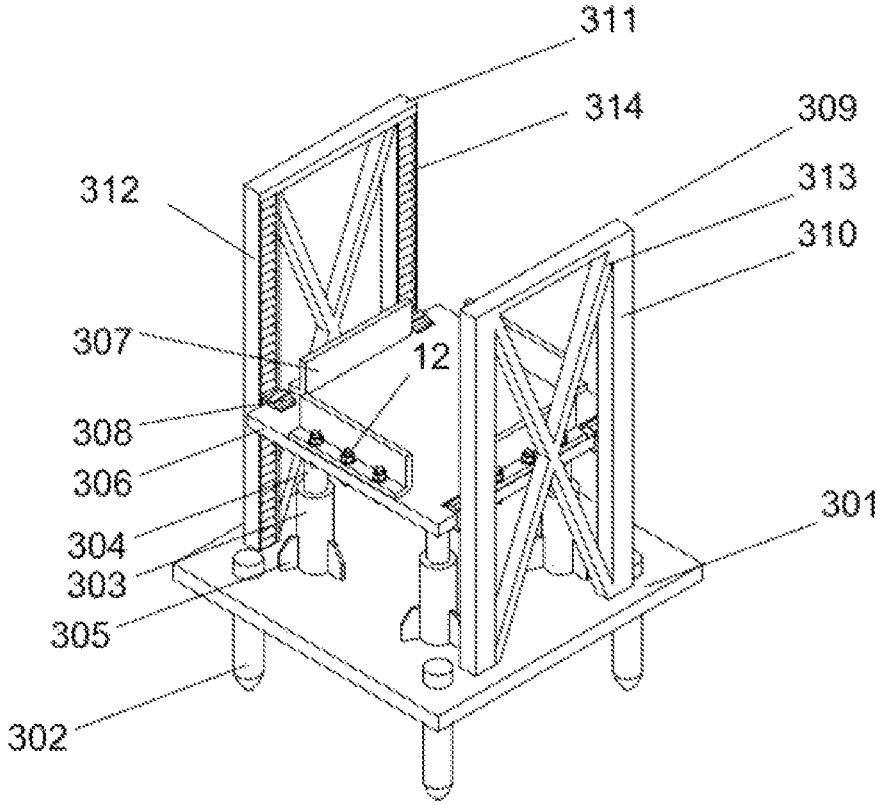
FIG. 7 is a schematic diagram of a hydraulic lifting mechanism of the integral lifting system for assembled members of the present invention.

As shown in FIG. 7, the hydraulic jacking mechanism 3 includes a fixing platform 301, steel anchor bolts 302, hydraulic oil cylinders 303, a jacking platform 306, a clamper 307, rotating gears 308 and more than two lifting frames 309, the steel anchor bolts 302 are fixed to a lower surface of the fixing platform 301, and an integral fixing effect is achieved on the device by anchoring the four steel anchor bolts 302 to underground positions. Four hydraulic oil cylinders 303 in the same specifications and matched pistons 304 are disposed on the fixing platform 301. Fixing sheets 305 are configured for reinforced connection in connecting positions of the hydraulic oil cylinders 303 and the fixing platform 301. The pistons 304 of the hydraulic oil cylinders 303 are fixedly mounted on an lower surface of the jacking platform 306, the clamper 307 and the lifting frames 309 are all fixedly mounted on an upper surface of the jacking platform 306, the clamper 307 is positioned between the lifting frames 309, the clamper 307 made of L-shaped steel is fixed to each of four edges of an upper plane of the jacking platform 306, and is configured to clamp and fix the vertical stand column 1 in the jacking process.

Vertical wave-shaped grooves 314 are formed in the lifting frames 309, rotating gears 308 are connected to two opposite side surfaces of the jacking platform 306 through four first rotating shafts in two groups, i.e., the rotating gears 308 are mounted on the jacking platform 306 through a first rotating shaft, and the wave-shaped grooves 314 are meshed and connected with the rotating gears 308. The lifting frames 309 are disposed in corresponding positions on the fixing platform 301, each of the lifting frames 309 is of a rectangular structure formed by welding vertical lifting steel pipes 310 and horizontal fixed steel pipes 312, and third inclined struts 313 are welded in a framework plane of the rectangular structure of each of the lifting frames 309. The rotating gears 308 can vertically move along the wave-shaped grooves 314, and are configured to ensure the coordinate and consistent jacking speeds and jacking heights of the four hydraulic oil cylinders 303 during the jacking of the hydraulic jacking mechanism 3.

Figure 4:
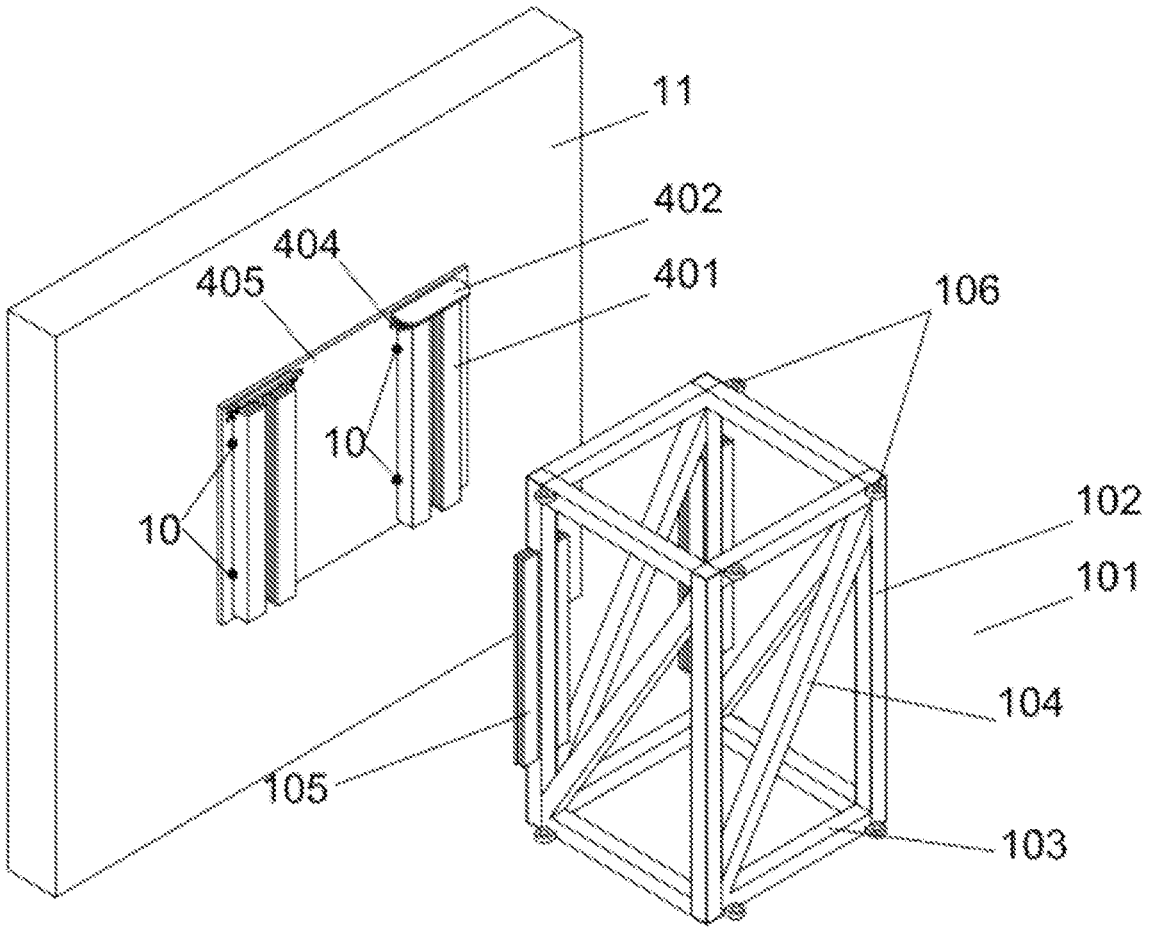
FIG. 4 is a schematic diagram of a vertical stand column and a fixing mechanism of the integral lifting system for assembled members of the present invention.
Figure 6:
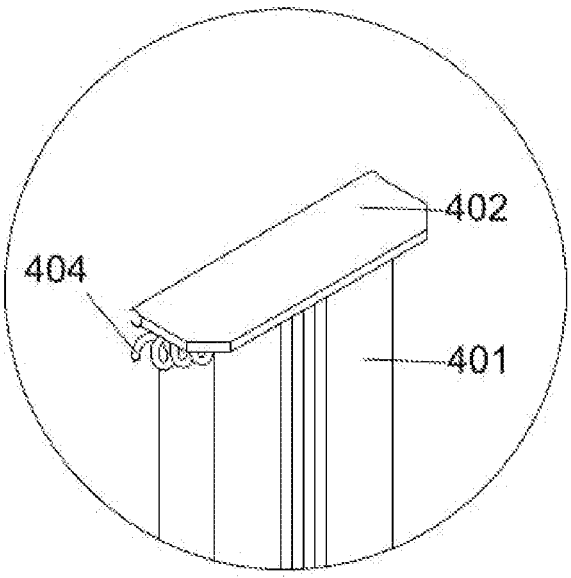
FIG. 6 is an enlarged view of the fixing mechanism of the integral lifting system for assembled members of the present invention.

As shown in FIG. 4 and FIG. 6, each of the fixing mechanisms 4 includes steel grooves 401 matched with the connecting sheets 105, support sheets 402, pin shafts 403, springs 404 and a fixing plate 405. The steel grooves 401 are four E-shaped multi-section long strip-shaped steel grooves in two groups, and the steel grooves 401 are welded onto the fixing plate 405, are firmly fixed to the prefabricated members 11 of the building through screw bolts 10, and are dismounted after construction. The arrangement position of each section of steel groove 401 is coordinate with the position of the vertical stand column 1, a length is the same as the length of the connecting sheet 105, and a certain interval is formed between the upper and lower sides of each section of steel groove 401. An arrangement direction of the steel grooves 401 is consistent with a sliding direction of the connecting sheets 105, and in order to achieve smooth sliding of the connecting sheets 105 in the steel grooves 401 and avoiding the influence on the stability of the fixing mechanisms 4 and the whole system at the same time, a certain thickness of metal paint is sprayed and coated onto surfaces of the steel grooves 401 and the connecting sheets 105, and lubricating agents are coated smeared inside the steel grooves 401 and outside the connecting sheets 105 during construction so as to reduce resistance generated during vertical movement. Each of the support sheets 402 is mounted on the top portion of the corresponding steel groove 401 through the pin shafts 403, thereby realizing the rotation of the support sheets 402 around the tops of the steel grooves 401 through the pin shaft 403. One end of each of the springs 404 is fixed onto the fixing plate 405, and the other end of each of the springs 404 is fixed to a lower surface of the corresponding support sheet 402. The hydraulic jacking mechanism 3 jacks the vertical stand columns 1 to upwards move, the tops of the vertical stand columns 1 touch and drive the support sheets 402 to be converted from a horizontal state into a vertical state around pin shafts 403, and the connecting sheets 105 of the vertical stand columns 1 can conveniently do vertical movement in the steel grooves. After the bottom portions of the connecting sheets 105 leave away from the tops of the steel grooves 401, the support sheets 402 return to the horizontal state again through being driven by the springs 404. After the hydraulic jacking mechanism 3 is reset, under the gravity of the vertical stand columns 1, lower end surfaces of the connecting sheets 105 abut against the upper surfaces of the support sheets 402, and the support sheets 402 achieve a support effect on each section of vertical stand column 1.

Figure 8:
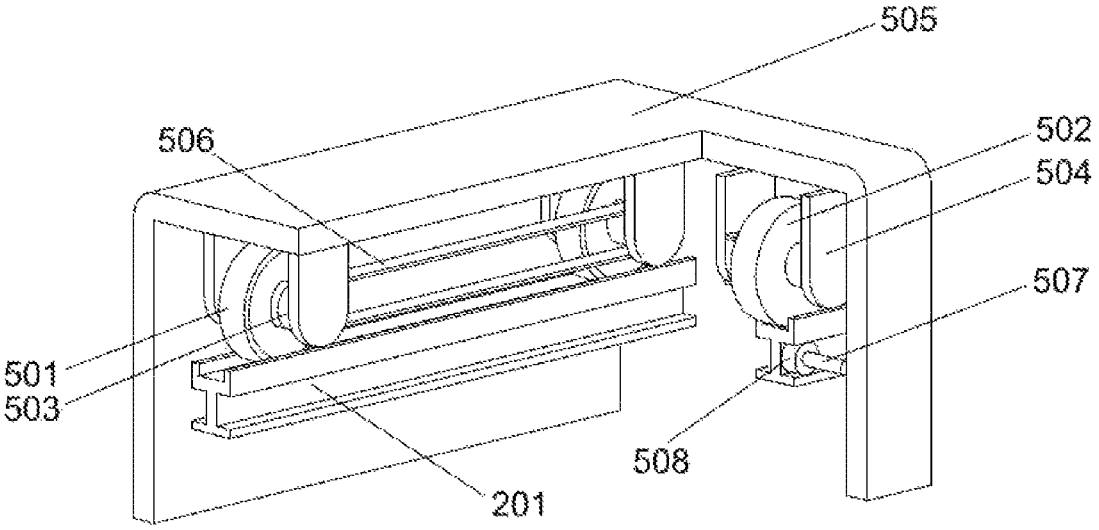
FIG. 8 is a schematic diagram of an operation trolley and an operation rail of the integral lifting system for assembled members of the present invention.

As shown in FIG. 8, the operation trolley 5 includes two first rear wheels 501, two first front wheels 502, second rotating shafts 503, fixing buckles 504, a trolley body 505, a conveying belt 506, third rotating shafts 507 and rotating wheels 508. The vehicle body 505 includes a trolley top plate and two trolley side plates. The two trolley side plates are respectively mounted at two sides of a lower surface of the trolley top plate. The second rotating shaft 503 respectively penetrates through the center of each of the first rear wheels 501 and the center of each of the first front wheels 502. Each of the second rotating shafts 503 is a driving device, and is able to drive the corresponding first rear wheel 501 or first front wheel 502 to enable the trolley to move on the transverse rail beams 2. The fixing buckles 504 are connected to two sides of the second rotating shafts 503. The upper ends of the fixing buckles 504 are fixed to the lower surface of the trolley top plate. The first rear wheels 501 and the first front wheels 502 are in transmission connection through the conveying belt 506. One end of each of the third rotating shafts 507 is disposed on the trolley side plate, the other end of each of the third rotating shafts 507 is connected with the rotating wheels 508, the number of rotating wheels 508 is four, the two of the rotating wheels 508 are located below the first front wheels 502, and the other two rotating wheels 508 are located below the first rear wheels 501. The first rear wheels 501 and the first front wheels 502 are located at upper surfaces of the operation rails 201, and the rotating wheels 508 are located in rail grooves at the outer sides of the middle portion of the operation rails 201. The operation trolley 5 can accordingly move together during operation, and the effect is to prevent the overturning of the operation trolley 5 during operation.

Figure 9:
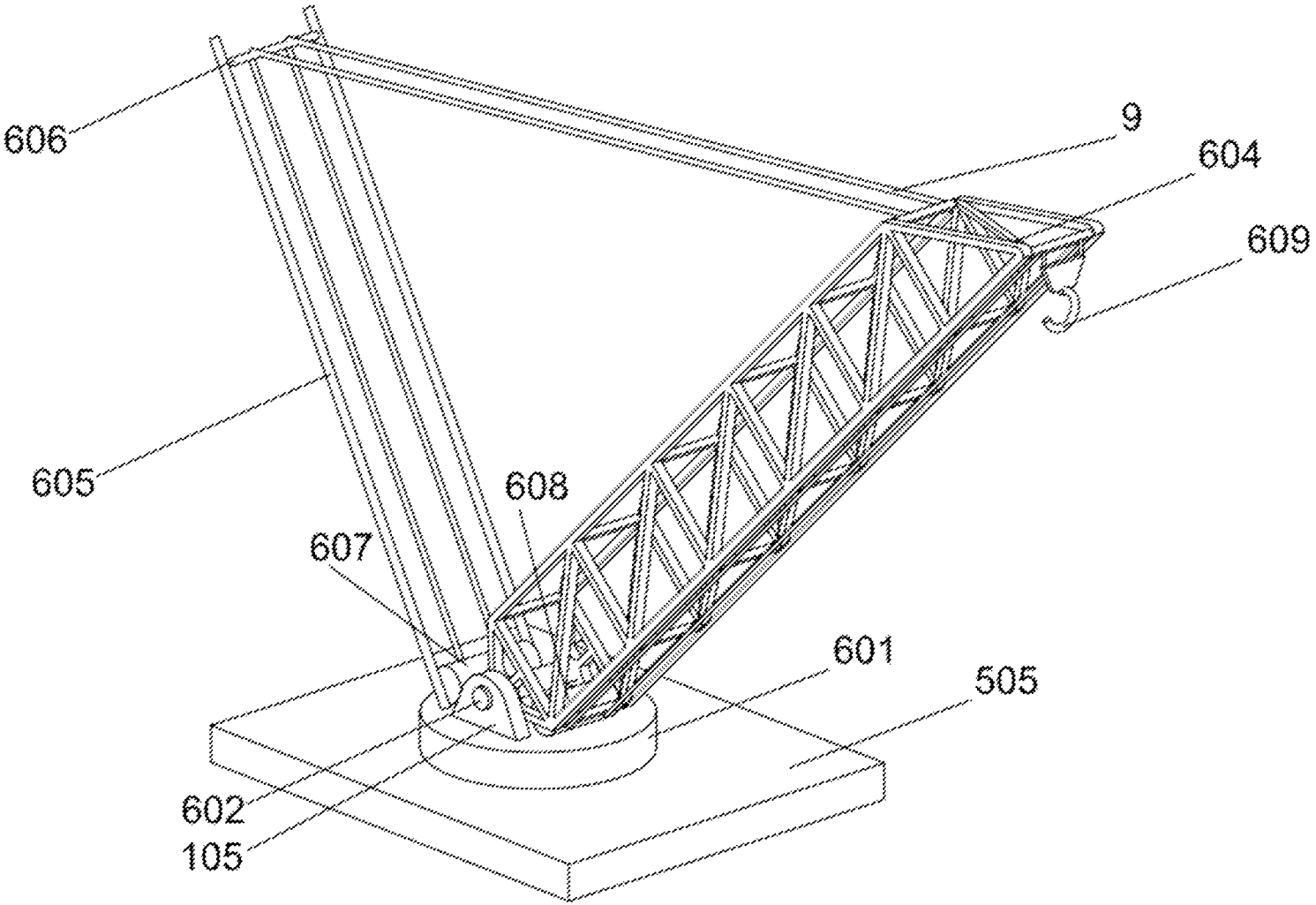
FIG. 9 is a schematic diagram of a jib crane of the integral lifting system for assembled members of the present invention.

As shown in FIG. 9, the jib crane 6 is mounted on the upper surface of the operation trolley 5, one jib crane 6 is mounted on the transverse rail beams 2 in each direction, performance parameters of the jib crane can be determined with the reference to those of an existing crane, and the jib crane 6 is more flexible in operation than the lifting mechanical arm 7, and can realize the vertical transportation and horizontal transportation process of members. The jib crane 6 includes a rotary platform 601, third connecting lugs 602, a rotary shaft 603, a jib boom 604, a pole derrick 605, a steering rod 606, a first windlass 607, a second windlass 608 and a first lifting hook 609. The rotary platform 601 is mounted on an upper surface of the operation trolley 5, the third connecting lugs 602 are disposed on the rotary platform 601, and the jib cane 6 is enabled to do 360° rotation. The jib boom 604 is rotationally connected with the third connecting lugs 602 through the rotary shaft 603, so that the jib boom 604 rotates in a vertical plane. The pole derrick 605 and the first windlass 607 are fixedly mounted on the rotary platform 601, the steering rod 606 is disposed on the top portion of the pole derrick 605, and steel wire ropes 9 fixed to an end portion of the jib boom 604 bypass the steering rod 606 at the top portion of the pole derrick 605 to be wound on the first windlass 607 and are configured to drag the jib boom 604 to move. The second windlass 608 is disposed at the bottom portion of the jib boom 604. The end portion of the jib boom 604 is provided a jib boom lifting point, and steel wire ropes 9 fixed to an end portion of the first lifting hook 609 pass through the jib boom lifting point to be wound on the second windlass 608.

Figure 10:
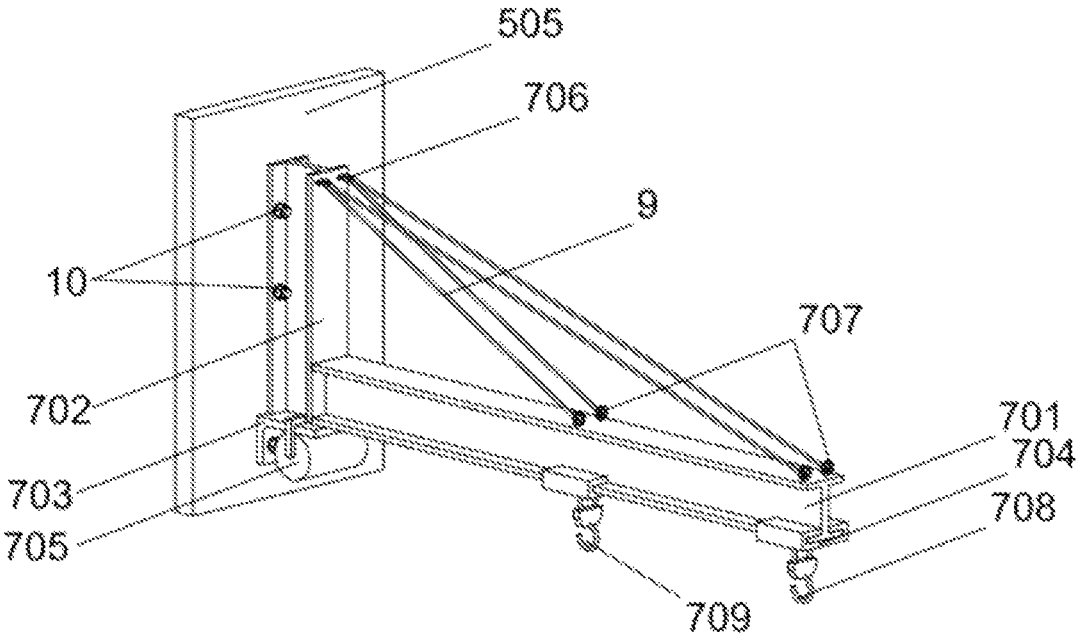
FIG. 10 is a schematic diagram of a lifting mechanical arm of the integral lifting system for assembled members of the present invention.

As shown in FIG. 10, each of the lifting mechanical arms 7 is mounted at an outer side surface of the operation trolley 5, the two lifting mechanical arms 7 are disposed on the transverse rail beams 2 in each direction, the lifting mechanical arms 7 only realize a lifting function of the assembled members in the vertical direction, the lifting mass is greater than that of the jib crane 6, and the operation is more stable. Each of the lifting mechanical arms 7 includes horizontal I-shaped steel 701, vertical I-shaped steel 702, an L-shaped support frame 703, annular clamp buckles 704, a third windlass 705, first binding rings 706, second binding rings 707, a second lifting hook 708 and a third lifting hook 709. The vertical I-shaped steel 702 is fixedly mounted on an outer side surface of the operation trolley 5 through screw bolt 10, and a lower surface of one end of the horizontal I-shaped steel 701 near the operation trolley 5 is fixedly connected to an outer side surface of the operation trolley 5 through the L-shaped support frame 703 via screw bolts 10. An included angle between the vertical I-shaped steel 702 and the horizontal I-shaped steel 701 is 90°. In order to prevent the instability of the horizontal I-shaped steel 701, the first binding rings 706 are disposed on the vertical I-shaped steel 702, the second binding rings 707 are disposed above an outer end surface and the middle portion of the horizontal I-shaped steel 701, one end of each steel wire rope 9 is connected with the corresponding first binding ring 706, and the other end of the steel wire rope 9 is connected with the corresponding second binding ring 707. The annular clamp buckles 704 are disposed below the outer end surface and the middle portion of the horizontal I-shaped steel 701 to be used as fixed lifting points, and the steel wire ropes 9 fixed to end portions of the second lifting hook 708 and the third lifting hook 709 respectively pass through the fixed lifting points to be wound on the third windlass 705.

Figure 11:
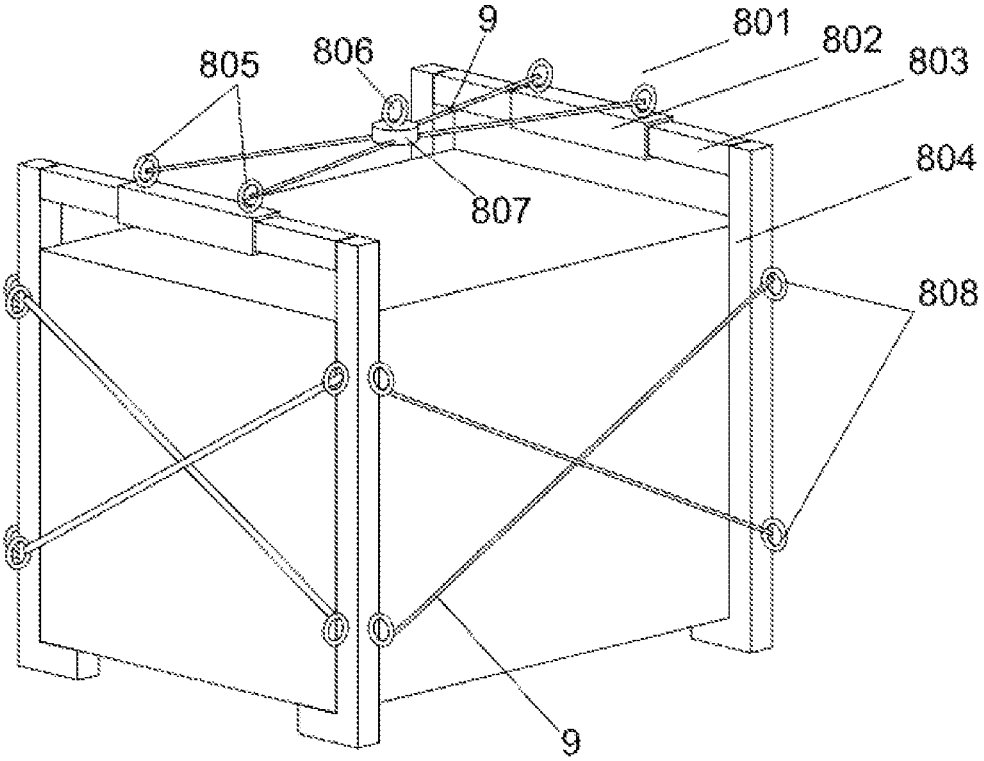
FIG. 11 is a schematic diagram of a lifting tool of the integral lifting system for assembled members of the present invention.

As shown in FIG. 11, the lifting tools 8 are configured to achieve a fixation effect during member lifting. Each of the lifting tools 8 includes two transverse lifting beams 801, four L-shaped clampers 804 and a lifting disc 807. Each of the transverse lifting beams 801 includes hollow first square-shaped steel 802 and second square-shaped steel 803, the second square-shaped steel 803 is disposed in the first square-shaped steel 802, the second square-shaped steel 803 is slidingly connected with the first square-shaped steel 802, the second square-shaped steel 803 can be pulled out or retracted back into the inside of the first square-shaped steel 802 according to the size of the members. The outer end surfaces of the second square-shaped steel 803 are respectively connected with the L-shaped clampers 804 configured to fix the side surface of the member. The upper ends of the L-shaped clampers 804 are fixedly connected with the second square-shaped steel 803, and clamping openings of the two L-shaped clampers 804 on the same transverse lifting beam 801 are disposed oppositely. In order to achieve stable lifting of the member during lifting, third binding rings 808 are disposed on the L-shaped clampers 804.

During lifting, the member is firmly bound with the lifting tool by passing the steel wire ropes 9 through the third binding rings 808. Two first lifting rings 805 are disposed on each of the first square-shaped steel 802, the lifting disc 807 and the first lifting rings 805 are connected through the steel wire ropes 9, and a second lifting ring 806 is disposed on the lifting disc 807, and is configured to hang the first lifting hook 609 and/or the second lifting hook 708 and/or the third lifting hook 709.

A use process of the present invention will be described in conjunction with FIG. 1 to FIG. 11 hereafter.

1. After building integral positioning and stringing and completion of underground work construction, arrangement positions and the quantity of vertical stand columns 1 are determined according to the scale of the building and the weight of prefabricated assembled members, a hydraulic jacking mechanism 3 is fixed in a corresponding position in advance, firmness and reliability of steel anchor bolts 302 are ensured, and performance of hydraulic oil cylinders 303 and matched pistons 304 is inspected.

2. A first section of a first cuboid framework 101 of the vertical stand column 1 is fixed onto a jacking platform 306 of the hydraulic jacking mechanism 3, and is tightly clamped by a clamper 307. The hydraulic jacking mechanism 3 is taken as a base to connect the vertical stand column 1 with transverse rail beams 2 through first connecting lugs 106, second connecting lugs 206 and screw bolts 12. An operation trolley 5, a jib crane 6 and a lifting mechanical arm 7 are mounted on the transverse rail beams 2. Each kind of lifting machinery (the jib crane 6 and the lifting mechanical arm 7) should be debugged without errors before use.

3. Before the lifting of the assembled members, fixation is performed by lifting tools 8. For small-size assembled members, a single-point lifting process can be completed by only using the jib crane 6 cooperating with a lifting disc 807. For big-size assembled members, the assembled members need to be fixed by transverse lifting beams 801, L-shaped clampers 802, a lifting disc 807 and steel wire ropes 9. First lifting rings 805 on the transverse lifting beams are connected with the second lifting hooks 708 and/or third lifting hooks 709 of the lifting mechanical arms 7, and the second lifting ring 806 on the lifting disc 807 is connected with the first lifting hook 609 of the jib crane 6. Firstly, four-point lifting is performed by using the lifting mechanical arms 7, so as to lift the assembled members to a specified height. In this process, the jib crane 6 does not undertake the main lifting tasks, and only cooperate with the lifting hooks. After the specified height is reached, the lifting mechanical arms 7 stop operation, the jib crane 6 further ascends, the first lifting rings 805 on the transverse lifting beams are disengaged from the second lifting hook 708 and/or the third lifting hook 709 of the lifting mechanical arm 7, and the assembled members are conveyed by the jib crane 6 to a specified position for installation. This process is repeated by the lifting work in each storey.

4. Through the mutual cooperation of the operation trolley 5, the jib crane 6 and the lifting mechanical arms 7, the installation process of the assembled members of the first storey is completed. Then, the hydraulic oil cylinders 303 and the matched pistons 304 of the hydraulic lifting mechanism 3 start to operate, jacking the whole lifting system until the fixation between the lifting system and a building body is completed through the connecting sheets 105 of the vertical stand columns 1 and the steel grooves 401 and the support sheets 402 of the fixing mechanisms, the jacking process is completed, the hydraulic oil cylinders 303 and the matched pistons 304 are reset, and the lifting system continuously completes lifting work at this height. After the lifting work at this height is completed, the lifting system is upwards jacked for a standard section by the hydraulic jacking mechanism 3 again, after the hydraulic oil cylinders 303 and the matched pistons 304 are reset, a new section of the first cuboid framework 101 is put at the bottom portion of the lifting system, and fixation of the two sections of the first cuboid frameworks 101 is completed with first connecting lugs 106 and screw bolts 10. This process is repeated in the subsequent jacking process.

The present invention has the advantages of convenient installation and construction, high safety, great lifting capacity and lifting stability, is applicable to lifting of assembled members in various specifications, improves the construction efficiency, and has good economic and technical values.

The foregoing descriptions are only exemplary implementations of the present invention. It should be pointed out that those skilled in the art can also make various improvements and modifications without departing from the principle of the present invention, and these improvements and modifications are also included within the protection scope of the present invention.

What is claimed is:

1. An integral lifting system for assembled members, the integral lifting system comprising a fixing mechanism and four vertical stand columns, wherein the four vertical stand columns are located at four corners of a building, the building is located in a region encircled by the vertical stand columns, a transverse rail beam is disposed between every two vertical stand columns, one end of the transverse rail beam is mounted at a top portion of one vertical stand column, and the other end of the transverse rail beam is mounted on a top portion of the other stand column; the transverse rail beam is provided with an operation trolley, a jib crane is disposed on an upper surface of the operation trolley, and lifting mechanical arms are disposed on an outer side surface of the operation trolley; and a hydraulic jacking mechanism is disposed at bottom portions of the vertical stand columns, each of the vertical stand columns comprises two vertically disposed first cuboid frameworks, each of the first cuboid frameworks is formed by welding first vertical square steel pipes and first horizontal square steel pipes, and connecting sheets are respectively disposed on two side surfaces of the vertical square steel pipes at one side of the first cuboid frameworks near a facade of the building; the connecting sheets are configured to be vertically and slidingly connected with the fixing mechanism; first connecting lugs are disposed on the horizontal square steel pipes at upper and lower ends of each of the first cuboid frameworks, and the vertically adjacent two first cuboid frameworks are fixedly connected through the first connecting lugs;

the transverse rail beam comprises operation rails and two transversely disposed second cuboid frameworks, each of the second cuboid frameworks is formed by welding second vertical square steel pipes and second horizontal square steel pipes, second connecting lugs are disposed on the second vertical square steel pipes at left and right ends of each of the second cuboid frameworks, and the two second cuboid frameworks are fixedly connected through the second connecting lugs; the operation rails are mounted on an upper surface of the second cuboid frameworks, and the operation rails are two parallel I-shaped rails; the hydraulic jacking mechanism comprises a fixing platform, steel anchor bolts, hydraulic oil cylinders, a jacking platform, a clamper rotating gears, and two lifting frames, the steel anchor bolts are fixed to a lower surface of the fixing platform, the hydraulic oil cylinders are fixedly mounted on an upper surface of the fixing platform, pistons of the hydraulic oil cylinders are fixedly mounted on a lower surface of the jacking platform, the clamper and the lifting frames are all fixedly mounted on an upper surface of the jacking platform, the clamper is positioned between the lifting frames, vertical wave-shaped grooves are formed in the lifting frames, the rotating gears are mounted on the jacking platform through a first rotating shaft, and the wave-shaped grooves are meshed and connected with the rotating gears;

the fixing mechanism comprises steel grooves matched with the connecting sheets, support sheets, pin shafts, springs and a fixing plate; the steel grooves are welded onto the fixing plate, the fixing plate is fixed to a prefabricated member of the building through screw bolts, a forming direction of the steel grooves is identical to a sliding direction of the connecting sheets, and each of the support sheets is mounted on a top portion of the corresponding steel groove through the pin shafts, such that the support sheets are rotatable around the top portions of the steel grooves through the pin shaft; one end of each of the springs is fixed onto the fixing plate, and the other end of each of the springs is fixed to a lower surface of the corresponding support sheet;

the operation trolley comprises two first rear wheels, two first front wheels, second rotating shafts, fixing buckles, a trolley body, a conveying belt, third rotating shafts and rotating wheels; the vehicle body comprises a trolley top plate and two trolley side plates;

the two trolley side plates are respectively mounted at two sides of a lower surface of the trolley top plate; the second rotating shafts respectively penetrate through a center of each of the first rear wheels (501) and a center of each of the first front wheels; each of the second rotating shafts is a driving device, and is able to drive a corresponding first rear wheel or first front wheel to enable the trolley to move on the transverse rail beam; the fixing buckles are connected to two sides of the second rotating shafts; upper ends of the fixing buckles are fixed to a lower surface of the trolley top plate; the first rear wheels and the first front wheels are in transmission connection through the conveying belt; one end of each of the third rotating shafts is disposed on one of the trolley side plates, the other end of each of the third rotating shafts is connected with the rotating wheels, a number of the rotating wheels is four, two of the rotating wheels are located below the first front wheels, and the other two rotating wheels are located below the first rear wheels; the first rear wheels and the first front wheels are located at upper surfaces of the operation rails, and the rotating wheels are located in rail grooves at outer sides of middle portions of the operation rails;

the jib crane comprises a rotary platform, third connecting lugs, a rotary shaft, a jib boom, a pole derrick, a steering rod, a first windlass, a second windlass and a first lifting hook; the rotary platform is mounted on the upper surface of the operation trolley, the third connecting lugs are disposed on the rotary platform, the jib boom is rotationally connected with the third connecting lugs through the rotary shaft, such that the jib boom rotates in a vertical plane; the pole derrick and the first windlass are fixedly mounted on the rotary platform, the steering rod is disposed on a top portion of the pole derrick, and steel wire ropes fixed to an end portion of the jib boom bypass the steering rod at the top portion of the pole derrick to be wound on the first windlass and are configured to drag the jib boom to move; and the second windlass is disposed at a bottom portion of the jib boom; the first lifting hook is disposed at the end portion of the jib boom, and steel wire ropes fixed to an end portion of the first lifting hook pass through the jib boom to be wound on the second windlass; and each of the lifting mechanical arms comprises horizontal I-shaped steel, vertical I-shaped steel, an L-shaped support frame, annular clamp buckles, a third windlass, first binding rings, second binding rings, a second lifting hook and a third lifting hook; the vertical I-shaped steel is fixedly mounted on the outer side surface of the operation trolley, and a lower surface of one end of the horizontal I-shaped steel near the operation trolley is fixedly connected to the outer side surface of the operation trolley through the L-shaped support frame; an included angle between the vertical I-shaped steel and the horizontal I-shaped steel is 90°; the first binding rings are disposed on the vertical I-shaped steel, the second binding rings are disposed above an outer end surface and a middle portion of the horizontal I-shaped steel, steel wire ropes are connected between the first binding rings and the second binding rings; the annular clamp buckles are disposed below the outer end surface and the middle portion of the horizontal I-shaped steel to be used as fixed lifting points, and steel wire ropes fixed to an end portion of the second lifting hook and an end portion of the third lifting hook respectively pass through the fixed lifting points to be wound on the third windlass.

2. The integral lifting system for assembled members according to claim 1, further comprising a lifting tool, wherein the lifting tool comprises two transverse lifting beams, four L-shaped clampers and a lifting disc; each of the transverse lifting beams comprises hollow first square-shaped steel and second square-shaped steel, the second square-shaped steel is disposed in the first square-shaped steel, the second square-shaped steel is slidingly connected with the first square-shaped steel, upper ends of the L-shaped clampers are fixedly connected with the second square-shaped steel, and clamping openings of two of the L-shaped clampers on the same transverse lifting beam are disposed oppositely; two first lifting rings are disposed on each of the first square-shaped steel, the lifting disc and the first lifting rings are connected through steel wire ropes, and a second lifting ring is disposed on the lifting disc; and the second lifting ring is configured to hang the first lifting hook and/or the second lifting hook and/or the third lifting hook.

3. The integral lifting system for assembled members according to claim 2, wherein each of the lifting frames is of a rectangular structure formed by welding vertical lifting steel pipes and horizontal fixed steel pipes.

4. The integral lifting system for assembled members according to claim 3, wherein third inclined struts are welded in a framework plane of the rectangular structure of each of the lifting frames.

5. The integral lifting system for assembled members according to claim 4, wherein fixing sheets are configured for reinforced connection in connecting positions of the hydraulic oil cylinders and the fixing platform.

6. The integral lifting system for assembled members according to claim 5, wherein a first inclined strut is welded in a framework plane of each of four side surfaces of the first cuboid frameworks.

7. The integral lifting system for assembled members according to claim 6, wherein a second inclined strut is welded in a framework plane of each of four side surfaces of the second cuboid frameworks.

8. An integral lifting method for assembled members, realized by providing the integral lifting system of claim 1 and performing the following steps:

step 1: after building integral positioning and stringing and completion of underground work construction, determining arrangement positions and a quantity of the vertical stand columns according to a scale of the building and a weight of prefabricated assembled members, fixing the hydraulic jacking mechanism in a corresponding position in advance, and inspecting performance of the hydraulic oil cylinders and the pistons;

step 2: firstly fixing a first section of the first cuboid framework of one of the vertical stand columns onto the jacking platform of the hydraulic jacking mechanism, and performing clamping by the clamper; then, taking the hydraulic jacking mechanism as a base to connect the vertical stand column with the transverse rail beams through the first connecting lugs, the second connecting lugs and the screw bolts, and mounting the operation trolley and lifting machinery on the transverse rail beams, wherein the lifting machinery comprises the jib crane and the lifting mechanical arms; and then, debugging the lifting machinery to ensure normal operation in use;

step 3: enabling the hydraulic oil cylinders and the pistons of the hydraulic jacking mechanism to start to operate, jacking the whole lifting system until the connecting sheets of the first section of the first cuboid framework pass through first steel grooves of the fixing mechanism and get supported by the support sheets horizontally disposed on upper sides of the first steel grooves so as to complete fixation between the lifting system and a building body, then completing a jacking process, and resetting the hydraulic oil cylinders and the pistons;

step 4: completing lifting and assembly of all assembled members of a first storey of the building corresponding to the first section of the first cuboid framework of the building through mutual cooperation of the operation trolley, the jib crane and the lifting mechanical arms, wherein during the lifting of the assembled members, the following two modes are adopted according to volumes of the assembled members:

for small-size assembled members, a single-point lifting mode is adopted, and the assembled members are able to be lifted to a specified height only by using the jib crane cooperating with a lifting disc; and for big-size assembled members, a four-point lifting mode is adopted, the lifting mechanical arms and a lifting tool in a specific structure form are used to lift the assembled members to a specified height; in this process, the first lifting hook of the jib crane only cooperates with the second lifting hook and/or the third lifting hook; after the assembled members reach a specified height, the lifting mechanical arms stop operation, the jib crane further ascends, first lifting rings on transverse lifting beams are disengaged from the second lifting hook and/or third lifting hook of the lifting mechanical arms, and the assembled members are conveyed by the jib crane to a specified position for installation until the assembly of all assembled member of a current storey of the building is completed; and the lifting tool comprises transverse lifting beams, L-shaped clampers, lifting disc and steel wire ropes; the first lifting rings on the transverse lifting beams are connected with the second lifting hook and/or third lifting hook of the lifting mechanical arms, and then, a second lifting ring on the lifting disc is connected with the first lifting hook of the jib crane;

step 5: upwards jacking the lifting system for a standard section by using the hydraulic jacking mechanism until the first section of the first cuboid framework passes through second steel grooves of the fixing mechanism and gets supported by support sheets horizontally disposed on upper sides of the second steel grooves, and resetting the hydraulic oil cylinders and the pistons; and then, putting a new section of the first cuboid framework at a bottom portion of the lifting system, and completing fixation of the new section of the first cuboid framework and the first section of the first cuboid framework with the first connecting lugs and the screw bolts; and repeating the steps 3 to 5 until the installation of the assembled members of each storey of the whole building is completed.

* * * * *